US005593566A

United States Patent [19]

Sharma

[11] Patent Number: 5,593,566

[45] Date of Patent: Jan. 14, 1997

[54] ELECTROLYTIC PRODUCTION PROCESS FOR MAGNESIUM AND ITS ALLOYS

[75] Inventor: Ram A. Sharma, Troy, Mich.

[73] Assignee: General Motors Corporation, Detroit, Mich.

[21] Appl. No.: 488,698

[22] Filed: Jun. 9, 1995

[51] Int. Cl.[6] ..... C25C 3/04

[52] U.S. Cl. ..... 205/363; 205/405; 205/404; 205/411

[58] Field of Search ..... 205/404, 405, 205/408, 407, 409, 411, 349, 363, 373

[56] References Cited

U.S. PATENT DOCUMENTS

| | | | |
|---|---|---|---|
| 2,880,151 | 3/1959 | Dean | 205/405 |
| 2,950,236 | 8/1960 | Dean et al. | 205/401 |
| 4,076,602 | 2/1978 | Wheeler | 205/404 |
| 4,131,522 | 12/1978 | Muzhzhavlev et al. | 205/405 |
| 4,495,037 | 1/1985 | Ishizuka | 205/405 |
| 5,089,094 | 2/1992 | Ogasawara | 205/405 |
| 5,279,716 | 1/1994 | Sharma | 205/404 |

OTHER PUBLICATIONS

Guden, M., et al., "Electrolysis of MgC12 with a top inserted anode and an Mg–Pb cathode," Journal of Applied Electrochemistry, vol. 24, No. 8 pp. 791–797 Aug. 1994.

Hampel, C., Ed., The Encyclopedia of Electrochemistry, Reinhold (New York) (1964). Jan. 1964.

*Primary Examiner*—Bruce F. Bell
*Assistant Examiner*—Brendan Mee
*Attorney, Agent, or Firm*—George A. Grove

[57] ABSTRACT

A process is disclosed for the electrolytic production of magnesium utilizing magnesium oxide and/or partially dehydrated magnesium chloride as a feedstock. An electrolyte containing magnesium chloride, potassium chloride and optionally sodium chloride is employed so that magnesium is produced. The magnesium is absorbed into a molten magnesium alloy cathode layer underlying the $MgCl_2$-KCl electrolyte. In a bipolar embodiment, pure magnesium is electrolytically transported from the magnesium alloy through a second molten salt electrolyte to an overlying electrode where the magnesium collects as a pool on the second electrolyte.

4 Claims, 1 Drawing Sheet

ELECTROLYTIC PRODUCTION PROCESS FOR MAGNESIUM AND ITS ALLOYS

This invention relates to the electrolytic production of magnesium metal and its alloys utilizing magnesium oxide and/or partially dehydrated magnesium chloride as a feedstock material.

BACKGROUND OF THE INVENTION

Magnesium and its alloys are recognized as having the lowest density of the structural metals. As such, they are used in many devices where low weight structural materials are valued. However, the cost of magnesium alloys is relatively high, and that limits their usage. The cost of magnesium is high as compared to that of aluminum despite the that there are several producers of magnesium metal, and the practices by which it is manufactured are of sufficient age that they have been subject to continuous improvements. Further, there are large resources of magnesium in sea water, brines, lakes and minerals such as magnesite, dolomite, etc.

In general, magnesium is produced by two processes: (1) magnesium chloride electrolysis and (2) thermal magnesium oxide reduction. The electrolysis process produces ¾ of the world's magnesium at a lower cost than the thermal process. There are similarities between the electrolytic processes which differ mainly in the preparation of magnesium chloride feed. Much of the cost of producing magnesium results from the preparation of magnesium chloride suitable for electrolytic reduction. This stems from the requirement of providing the magnesium chloride in a form free of magnesium oxide or in a sufficiently dehydrated form that magnesium oxide formation in the electrolyte is minimized or avoided. The presence of undissolved magnesium oxide in the present electrolyte compositions leads to the formation of magnesium-containing sludge which results in losses of magnesium and reduces process efficiencies.

There remains a substantial need for magnesium production processes that can utilize magnesium oxide or partially dehydrated magnesium chloride as a feed material without forming magnesium oxide from the hydrated feedstock.

SUMMARY OF THE INVENTION

The subject invention provides a method of producing magnesium metal or a magnesium-aluminum alloy in an electrolytic cell using a feedstock containing magnesium oxide or partially dehydrated magnesium chloride. As used in this specification, the term "dehydrated magnesium chloride" means a formula unit of magnesium chloride with three or less associated water formula units of crystallization (e.g., $MgCl_2.xH_2O$, where $O<x\leqq 3$).

In broad concept, an electrolytic cell is provided utilizing an electrolyte that comprises magnesium cations, potassium cations and sodium cations and chloride anions. They are used in proportions such that the density of the molten salt electrolyte is less than the density of an underlying molten magnesium-aluminum alloy layer that is employed as a cathode and to receive magnesium produced in the process. A nonconsumed anode such as a graphite anode is employed to complete the electrical circuit of the cell.

In a preferred embodiment, electrolyte is made up of a salt mixture initially consisting, by weight, of about 5 to 25 percent magnesium chloride, 60 to 80 percent potassium chloride, and 0 to 20 percent sodium chloride. An initial mixture consisting essentially of 20 weight percent magnesium chloride, 65 weight percent potassium chloride and 15 weight percent sodium chloride is especially preferred. The cathode is formed of a molten metal alloy preferably consisting of 50 to 95 percent magnesium and the balance aluminum. Other alloying constituents for magnesium may be incorporated into this molten cathode layer, provided they do not interfere with the electrolysis process and that the layer remains heavier than the electrolyte. The composition of the electrolyte and the molten cathode layer are controlled so that the molten salt electrolyte is of lower density than the cathode layer and floats as a clearly distinct liquid layer on the molten metal layer. The mixture is heated to a cell operating temperature where the salt and metal layers are liquid, suitably in the range of 700° C. to 850° C. An anode is immersed in the molten electrolyte. A suitable anode material is a composite graphite body, such as a suitable commercially available composition.

In the operation of the cell, a suitable direct current potential, e.g., of the order of 4 to 5 volts, is applied between the anode and the cathode. Chlorine gas is formed at the anode by oxidation of chloride anions in the electrolyte. Magnesium metal is produced at the electrolyte-cathode interface by reduction of magnesium cations in the electrolyte.

A unique feature of the invention is that in this electrolyte composition-heavy molten cathode combination a feedstock containing magnesium oxide or partially hydrated magnesium chloride may be added to the upper surface of the electrolyte without the formation of an efficiency- and yield-reducing magnesium-oxygen containing sludge in the bath. Preferably, the magnesium oxide and/or partially hydrated magnesium chloride is added in the form of powder distributed over the surface of the electrolyte layer. As the particles sink into the electrolyte, they react with the chlorine gas that is produced during the electrolysis process and bubbling up through the electrolyte. The chlorine gas reacts with magnesium oxide to produce magnesium chloride and oxygen. In the event that partially hydrated magnesium chloride (e.g., $MgCl_2.2H_2O$) is employed as a part or all of the feedstock, the temperature of the bath and the bubbling chlorine results in the evolution of chlorine and water vapor from the bath with minimal formation of magnesium oxide-containing sludge materials.

The magnesium content of the electrolyte is maintained if the feedstock is added at a rate comparable with the electrolytic reduction and removal of magnesium cations from the electrolyte. Magnesium metal is produced at the electrolyte-cathode interface and absorbed into the underlying molten magnesium-aluminum alloy. The evolution of chlorine gas at the anode above the cathode converts any magnesium oxide in the feedstock to magnesium chloride.

The advantages of the subject process are that it produces magnesium at the bottom surface of the electrolyte to minimize magnesium contamination and that the chlorine generated at the anode reacts with any magnesium oxide in the electrolyte to produce sludge-free magnesium chloride. There is little opportunity for chlorine to react with magnesium because magnesium is generated below the anode.

Other objects and advantages of this invention will become more apparent from a detailed description thereof which follows. In the course of this description, reference will be had to the drawings.

DESCRIPTION OF PREFERRED EMBODIMENTS

The practice of the subject electrolytic magnesium production method will be better understood in view of a description of apparatus suitable for the practice of the method.

Unipolar Cell Embodiment

Figure 1:
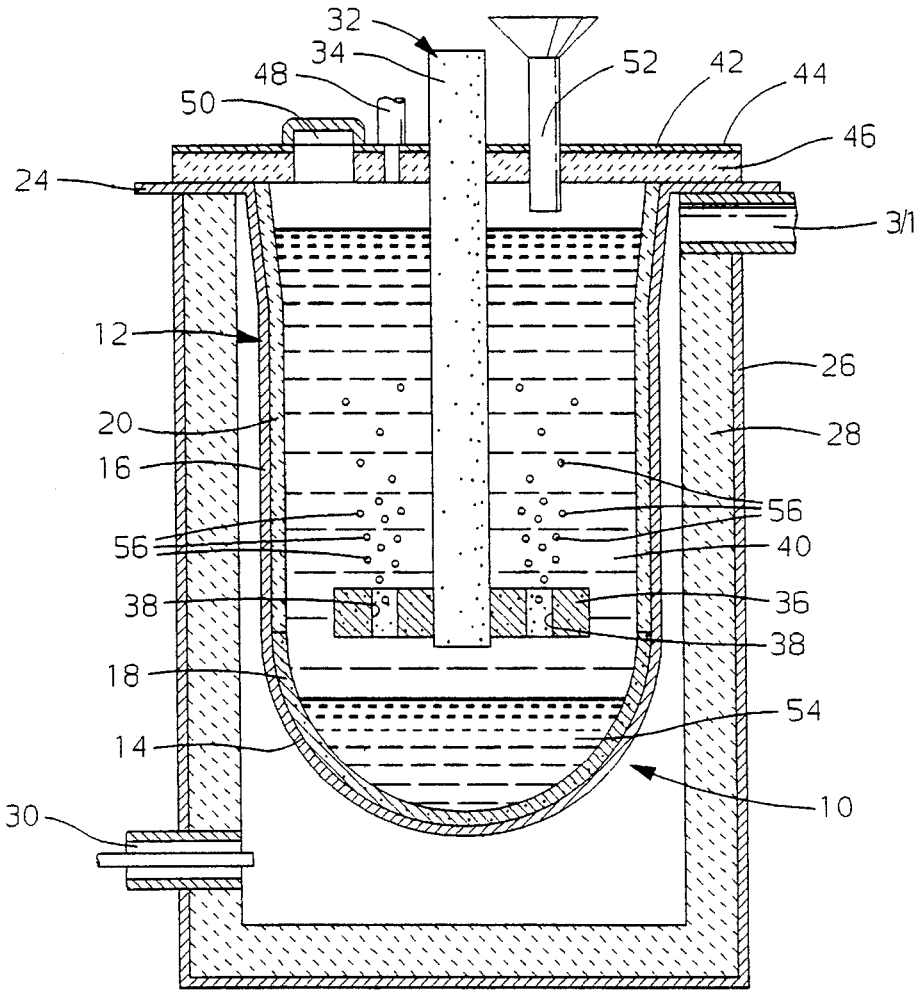
FIG. 1 is a schematic diagram in cross section of an electrolytic cell utilizing a graphite anode, an electrolyte of the subject composition and a molten magnesium alloy cathode.

FIG. 1 is a sectional view of an electrolytic cell 10. The cell comprises a cast steel pot 12 with a hemispherical base portion 14 and a cylindrical upper portion 16. The base portion is provided with a carbon lining 18, and the upper cylindrical portion is provided with a refractory lining 20. The carbon lining is adapted to contain a molten magnesium-aluminum alloy or other suitable magnesium alloy 54 which serves both as the cathode and a below-the-electrolyte repository for the newly-produced magnesium metal. The upper lip of the cylindrical portion of the pot serves as a cathode lead 24. Steel pot 12 is supported on and contained within an outer steel shell 26. Steel shell 26 has a suitable can-like shape and is provided with an internal refractory lining 28 to serve as a heating furnace for cast steel pot 12. In order to facilitate the heating of cast steel pot 12 and its contents, a coaxial opening 30 for gas and air is provided at the lower portion of shell 26 and a gas exhaust 31 is provided at the upper end of steel shell can 26.

The heating unit of this apparatus is adapted to heat the electrolytic cell pot 12 and its contents to a controllable temperature in the range of 700° C. to 850° C. over prolonged periods of time.

A graphite anode 32 comprising a long cylindrical shaft 34 with a flat pancake-shaped base 36 with perforations 38 is adapted to be inserted into a molten electrolyte 40. The composite anode 32 is carried in a top closure member 42 which comprises a steel plate 44 and is protected on the inside surface with a refractory lining 46. A packing gland (not shown) serves to enclose the anode shaft 34 to prevent egress of materials from the pot other than as desired. Also included in the top 42 is a gas vent 48 to permit exit of chlorine gas or oxygen gas as will be described. Also included in top 42 is a port 50 (shown closed) through which magnesium or magnesium-aluminum alloy may be siphoned from time to time as necessary and desired. There is also included in the top 42 a feedstock opening 52 to introduce powdered magnesium oxide or partially hydrated magnesium chloride into the electrolytic cell.

In the operation of the electrolytic cell 10, solid metal alloy capable of forming a magnesium-aluminum alloy, for example, is added to the pot and heated until it is molten. The molten cathode is shown at 54 in FIG. 1. A suitable magnesium alloy is one that comprises about 50 to 90 percent by weight magnesium and the balance aluminum. This magnesium alloy is formulated to serve at least two purposes. First, the alloy is to be of higher density than the potassium chloride-magnesium chloride electrolyte. Pure magnesium has about the same density as KCl-20% $MgCl_2$ mixtures at cell operating temperature. However, magnesium-aluminum alloys containing more than about ten percent by weight aluminum fulfill the higher density requirement. Second, the goal is to produce an alloy useful "as is". Thus, the magnesium alloy may contain other heavier alloying constituents such as zinc and copper. Magnesium may also be alloyed with copper or zinc (instead of aluminum) to serve as the under-the-electrolyte cathode.

The electrolyte 40 is a salt mixture consisting essentially of about three to five parts by weight of KCl per part of $MgCl_2$. These mixtures provide the desired electrolyte density and reactivity between chlorine and magnesium oxide. Other constituents such as sodium chloride may be added to adjust melting point, melt fluidity and the like. The electrolyte 40 preferably initially consists of, for example, 65 percent by weight potassium chloride, 15 percent by weight sodium chloride, and 20 percent by weight anhydrous magnesium chloride is added to the pot and heated until it is molten. Suitable mixtures include, by weight, 5 to 25 percent $MgCl_2$, 0 to 20 percent NaCl and 60 to 80 percent KCl. A small amount, e.g., about one percent by weight, of calcium fluoride may be added to the salt mixture since it appears to promote cleanliness of the electrolyte in cell operation. At this point, the anode 32 is immersed in the molten electrolyte 40 and the top is closed and the system is ready for operation.

A suitable direct current potential, for example, about 4 to 5 volts, is applied between the cathode lead 24 and the graphite anode 34. The anode is maintained at a positive potential with respect to the cathode. A preferred operating temperature for the system is about 750° C. At this temperature, the cathode is more dense than the molten salt electrolyte, and the electrolyte can sustain reactions (described below) between chlorine and magnesium oxide to produce magnesium chloride. Upon application of the direct current potential, electrolysis of the magnesium cations and chloride anions occurs, whereupon magnesium cations are reduced at the interface of the molten salt electrolyte 40 and the molten cathode 54, and magnesium metal is absorbed into the molten cathode. Concomitantly, chloride anions are oxidized at the anode base 36 and perforations 38 and chlorine gas is emitted which bubbles 56 upwardly through the electrolyte 40 toward the gas vent 48. At this time, magnesium oxide, preferably in powder form (not shown), may be slowly added through feed opening 52 and distributed over the top of the electrolyte 40. As the powder sinks in the electrolyte 40, it reacts with the chlorine gas to form magnesium chloride and oxygen gas.

This reaction of magnesium oxide with the chlorine gas in the electrolyte 40 is a unique aspect of this invention. The reaction between magnesium oxide and chlorine gas is thermodynamically possible in potassium chloride-magnesium chloride electrolyte composition at the temperature of the cell. Furthermore, by producing the magnesium metal at the bottom of the molten electrolyte layer 40, the chlorine gas does not react with the magnesium to reform magnesium chloride. Magnesium chloride that is formed in the electrolyte layer comes from the in situ reacted magnesium oxide feedstock. In the event that a partially hydrated magnesium chloride ($MgCl_2.xH_2O$, where $O<x\leqq$about 3) is employed as a part of the charge, it is dehydrated by the hot molten electrolyte and the presence of the chlorine gas helps to prevent sludge formation. Vaporous water is just carried out of the system with the gases that are otherwise emitted from the electrolyte.

As the magnesium thus accumulates in the molten magnesium-aluminum alloy, some of the magnesium-aluminum alloy is removed. Additional aluminum and/or other suitable alloying constituents are added to boot layer 54 to maintain the cathode composition. Magnesium oxide and/or partially dehydrated magnesium chloride are added to the top of the electrolyte layer 40. In this way, magnesium metal can be more or less continuously produced and magnesium-aluminum alloy periodically removed by siphoning or other suitable means from the bottom of the operating cell 10.

A unipolar cell has been operated at a typical voltage of 4.3 volts dc. The typical operating current was about five amperes at a current density of about 1 amp/cm$^2$. Magnesium-aluminum alloy was produced at a current efficiency of about 91 percent.

Bipolar Cell Embodiment

Figure 2:
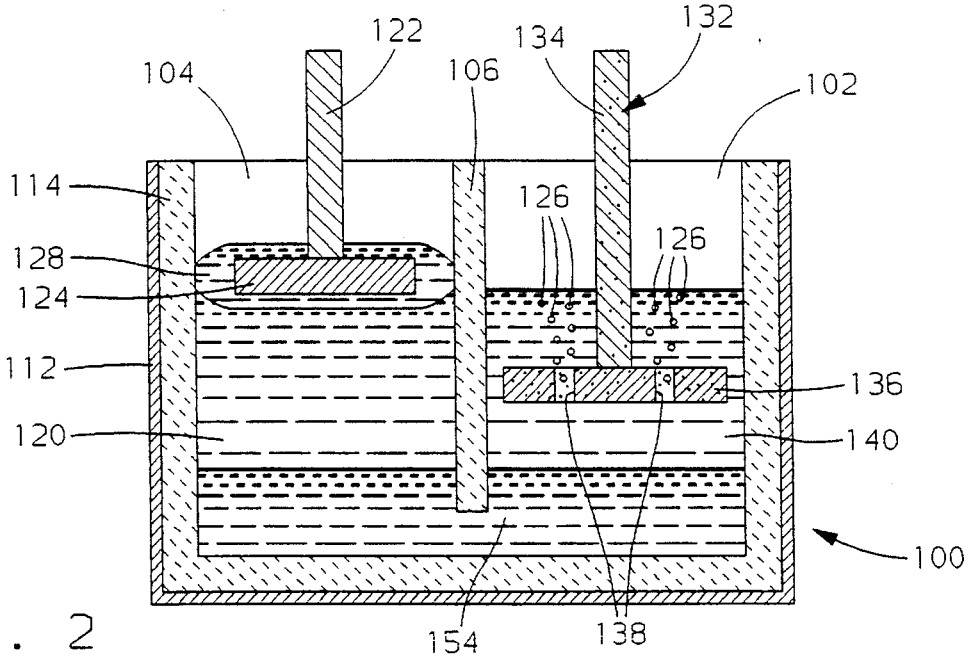
FIG. 2 is a schematic diagram of a cell in which the magnesium aluminum alloy serves as a bipolar electrode.

FIG. 2 illustrates another apparatus suitable for the practice of the subject method. In this apparatus depicted in FIG. 2, a relatively dense magnesium-aluminum alloy is again employed as an electrode and to absorb magnesium. However, in this arrangement the alloy serves as a bipolar electrode. It serves as the cathode in one electrolytic cell and as the anode in a second adjacent (but separate) electrolytic cell as will be described.

FIG. 2 depicts a two-compartment cell illustrated generally at 100. The cells are contained in a rectangular or cylindrical steel shell 112 that is provided with a suitable refractory lining 114 adapted to contain both the magnesium-aluminum melt and two different electrolytes. For simplification of illustration and explanation, no furnace enclosure is shown around cell 100. However, it is to be understood that cell 100 is to be heated and enclosed as is cell 10 in FIG. 1.

Cell vessel 100 is divided into two compartments 102 and 104 by a refractory diaphragm 106 which electrochemically isolates electrolytic cells 102 and 104. Electrolytic cells 102, 104 have a common electrode 154, a molten magnesium alloy melt at the bottom. The molten magnesium-aluminum (for example) alloy melt is heavier than either electrolyte which floats on top of it in cells 102 and 104. Cell 102 is an anode compartment that employs a molten salt electrolyte 140 of substantially the same composition as that employed in the cell 10 depicted in FIG. 1. Specifically, electrolyte 140 suitably comprises magnesium chloride, potassium chloride, sodium chloride and a small amount of calcium fluoride. $MgCl_2$ and KCl are the essential constituents. Immersed in electrolyte 140 is a graphite anode 132 which may be similar to that depicted in a FIG. 1 cell. Anode 132 comprises shaft 134 and base 136 with perforations 138. Molten magnesium-aluminum alloy layer 154 is the cathode for cell 102. As seen in FIG. 2, alloy 154 underlies both cell compartments 102 and 104.

Cathode compartment 104 employs an electrolyte 120 that may differ or be the same in composition as that of electrolyte 140. For example, electrolyte 120 may be a composition that is commonly used in electrolytic magnesium production, i.e., a composition comprising magnesium chloride, calcium chloride, sodium chloride and a small amount of calcium fluoride. The cathode 122 contains a steel plate 124 immersed at the upper surface of the cathodic compartment electrolyte 120. In the operation of bipolar cell 100, a direct current potential is applied, positive to the anode 132, negative to the cathode 122, and the cell 100 is thereby energized. In the anode compartment 102, magnesium cations are reduced at the interface of the electrolyte 140 and the bipolar melt 154 (which acts as a cathode in cell 102) to introduce magnesium metal into the molten alloy 154. At the same time, chloride anions are oxidized at the anode to produce chlorine gas, seen in bubbles 126 in electrolyte 140. As in the operation of the FIG. 1 cell, magnesium oxide or partially dehydrated magnesium chloride may be added to the electrolyte to replace the magnesium depleted from the electrolyte.

The operation of the cathodic compartment 104 is to transport magnesium metal from the bipolar magnesium alloy melt 154 at the bottom of compartment 104 to the top surface of electrolyte 120. This is accomplished by reoxidizing it as magnesium ions in electrolyte 120 and then reducing the ions again at the steel cathode plate 124. Pure magnesium metal is thus produced at cathode plate 124 and accumulates until removed from the upper surface of heavier electrolyte 120. In this way, this bipolar electrode cell 100 can be operated so as to add magnesium oxide or partially hydrated magnesium chloride to the anodic compartment 102, recover pure magnesium metal 128 in the magnesium alloy bipolar electrode melt, and then transport essentially pure magnesium from the bipolar electrode melt 154 for recovery at the upper surface of the cathode electrolyte 120 as molten magnesium metal.

Thus, this invention utilizes a combination of a potassium chloride-magnesium chloride and, optionally, sodium chloride electrolyte with a molten magnesium alloy cathode of higher density. This electrolyte-cathode combination permits the high efficiency and high yield formation of essentially pure magnesium metal or magnesium alloy even when utilizing a magnesium oxide or partially dehydrated magnesium chloride feedstock. The use of this relatively inexpensive feedstock with a clean electrolyte and clean product reduces the cost of magnesium production. Magnesium has thus been produced in cathode alloy form at electrical efficiencies of 80% to 90%. or at an energy expenditure of 11 to 13 kwh/kg of magnesium produced in alloy form.

In the unipolar embodiment, the evolution of chlorine gas at the anode leads to successful chlorination of magnesium oxide in the KCl-$MgCl_2$ electrolyte. Magnesium produced at the interface of the electrolyte and underlying magnesium alloy is unaffected by the chlorine gas and uncontaminated by feedstock byproducts, if any.

The bipolar embodiment of the invention utilizes the same electrolyte in an anode cell compartment overlying a molten magnesium alloy. This alloy serves as the cathode for the anode compartment cell and as the anode in an adjacent but separate cathode cell. Magnesium metal is produced from MgO and/or partially hydrated $MgCl_2$ in the anode cell and absorbed into the molten cathode alloy. In the overlying adjacent cathode cell, magnesium is electrolytically transported from the alloy now functioning as an anode to a cathode where pure molten magnesium is collected.

While this invention has been described in terms of certain preferred embodiment thereof, it will be appreciated that other forms could readily be adapted by one skilled in the art. Accordingly, the scope of this invention is to be considered limited only by the following claims.

What is claimed is:

1. A method of producing magnesium or magnesium alloys from a feedstock containing magnesium oxide comprising:

providing an electrolytic cell comprising (a) a molten salt electrolyte initially consisting essentially of one part by weight magnesium chloride and three to five parts by weight potassium chloride; (b) a molten metal cathode comprising a magnesium alloy having a density greater than that of said electrolyte; and (c) a nonconsumed anode immersed in said electrolyte, heating the contents of the electrolytic cell to an operating temperature at which the electrolyte and cathode are molten, applying a direct current potential between said anode and cathode to produce chlorine gas at said anode and to reduce magnesium cations in said electrolyte to produce magnesium metal at the interface of said electrolyte and said cathode, such magnesium being absorbed into said cathode layer, and adding said feedstock to said electrolyte where it reacts with said chlorine gas as it is emitted to replenish magnesium cations in said electrolyte.

2. A method of producing magnesium from a feedstock containing magnesium oxide comprising:

providing an electrolytic cell comprising (a) a molten salt electrolyte initially consisting essentially of 5 to 25 percent by weight magnesium chloride, 60 to 75 percent by weight potassium chloride, and 0 to 20 percent sodium chloride; (b) a molten metal cathode comprising a magnesium alloy having a density greater than that of said electrolyte; and (c) an anode immersed in said electrolyte, heating the contents of the electrolytic cell to a temperature in the range of 700° C. to 850° C., applying a direct current potential between said anode and cathode to produce chlorine gas at said anode and to reduce magnesium cations in said electrolyte to produce magnesium metal at the interface of said electrolyte and said cathode, such magnesium being absorbed into said cathode layer, and adding said feedstock oxide to said electrolyte wherein it reacts with said chlorine gas as it is emitted to replenish magnesium cations in said electrolyte.

3. A method of producing magnesium from a feedstock containing magnesium oxide and/or partially dehydrated magnesium chloride comprising:

providing a first confined electrolytic cell comprising (a) a first molten salt electrolyte consisting essentially of, by weight, one part magnesium chloride and three to five parts potassium chloride; (b) a molten magnesium alloy cathode having a density greater than that of said electrolyte and underlying said electrolyte; and (c) an anode immersed in said electrolyte, providing a second confined electrolytic cell comprising (a) a second molten salt electrolyte comprising magnesium cations and chloride anions, said second electrolyte overlying a portion of said molten alloy but separated from said first electrolyte and (b) a cathode immersed in the second electrolyte, said molten alloy serving as the cathode in said second cell, and applying a direct current potential between said first cell anode and said second cell cathode to produce chlorine gas at said anode and magnesium at the interface of said first electrolyte and said molten metal alloy, said magnesium there being absorbed into said alloy, and magnesium further being electrolytically transported in said second cell from said molten alloy to the cathode in said second cell where magnesium is deposited and collected.

4. A method of producing magnesium from a feedstock containing magnesium oxide and/or partially dehydrated magnesium chloride comprising:

providing a first confined electrolytic cell comprising (a) a first molten salt electrolyte consisting essentially of, by weight, 5 to 25 percent magnesium chloride, 60 to 80 percent potassium chloride and 0 to 20 percent sodium chloride; (b) a molten metal alloy cathode having a density greater than that of said electrolyte and underlying said electrolyte; and (c) an anode immersed in said electrolyte, providing a second confined electrolytic cell comprising (a) a second molten salt electrolyte comprising magnesium cations and chloride anions, said second electrolyte overlying a portion of said molten alloy but separated from said first electrolyte, (b) a cathode immersed at the upper surface of the second electrolyte, and (c) said molten alloy serving as the anode in said second cell, and applying a direct current potential between said first cell anode and said second cell cathode to produce chlorine gas at said anode and magnesium at the interface of said first electrolyte and said molten metal alloy, said magnesium being absorbed into said alloy in said first cell, and magnesium being electrolytically transported from said molten alloy in said second cell to the cathode in said second cell where magnesium is deposited and collected.

* * * * *